US010915070B2

(12) United States Patent
Murai

(10) Patent No.: US 10,915,070 B2
(45) Date of Patent: Feb. 9, 2021

(54) IMAGE DISPLAY APPARATUS, IMAGE DISPLAY METHOD AND STORAGE MEDIUM

(71) Applicant: CASIO COMPUTER CO., LTD., Tokyo (JP)

(72) Inventor: Kazuaki Murai, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 227 days.

(21) Appl. No.: 15/711,259

(22) Filed: Sep. 21, 2017

(65) Prior Publication Data

US 2018/0088537 A1 Mar. 29, 2018

(30) Foreign Application Priority Data

Sep. 23, 2016 (JP) ..... 2016-185354

(51) Int. Cl.
*G04G 9/12* (2006.01)
*G04B 19/04* (2006.01)
(Continued)

(52) U.S. Cl.
CPC ..... *G04G 9/126* (2013.01); *G04B 19/04* (2013.01); *G04C 17/0091* (2013.01);
(Continued)

(58) Field of Classification Search
CPC ..... G04G 9/126; G04G 17/02; G04G 9/087; G04G 9/0064; G04G 9/0082; G04B 19/04; G04C 17/0091
See application file for complete search history.

(56) References Cited

U.S. PATENT DOCUMENTS 9,891,595 B2 * 2/2018 Pitis ..... G04G 9/022
2002/0099452 A1 * 7/2002 Kawai ..... G04G 9/0011 700/16

(Continued)

FOREIGN PATENT DOCUMENTS

CN 104765266 A 7/2015
JP 2003-307580 A 10/2003

(Continued)

OTHER PUBLICATIONS

Notice of Reasons for Refusal dated Aug. 22, 2019 in Japanese Patent Application No. 2016-185354.

(Continued)

*Primary Examiner* — Sean Kayes
(74) *Attorney, Agent, or Firm* — Scully Scott Murphy & Presser

(57) ABSTRACT

The present invention is to reduce an increase in a processing load when a background image is displayed in addition to pointer images indicating pointer movements. A control section displays a plurality of pointer images indicating pointer movements in a timepiece display area of a display section based on time information acquired from a clock circuit. Here, the control section identifies an area where the plurality of pointer images are displayed, such as a pointer movement area or a pointer presence area in the pointer movement area, and controls to perform high-load and low-load display operations with different processing loads on the identified area and an area other than the identified area, such as an outer area outside the pointer movement area or a pointer absence area in the pointer movement area, respectively.

14 Claims, 10 Drawing Sheets

(51) Int. Cl.

| | |
|---|---|
| ***G04G 9/08*** | (2006.01) |
| ***G04G 9/00*** | (2006.01) |
| ***G04C 17/00*** | (2006.01) |
| *G04G 17/02* | (2006.01) |

(52) U.S. Cl.
CPC ..... *G04G 9/0064* (2013.01); *G04G 9/0082* (2013.01); *G04G 9/087* (2013.01); *G04G 17/02* (2013.01)

(56) References Cited

U.S. PATENT DOCUMENTS

2012/0169923 A1* 7/2012 Millar ..... H04N 19/23 348/399.1
2015/0323906 A1* 11/2015 Yang ..... G04G 19/12 368/224
2016/0125785 A1* 5/2016 Wang ..... G09G 5/001 345/582
2016/0299679 A1* 10/2016 Park ..... G06F 1/163
2017/0153606 A1* 6/2017 Pitis ..... G04G 9/0082
2018/0157452 A1* 6/2018 Nelson ..... G06F 3/1407

FOREIGN PATENT DOCUMENTS

JP 2009-293960 A 12/2009
JP 2016-071114 A 5/2016

OTHER PUBLICATIONS

First Office Action dated Aug. 12, 2019 received in Chinese Patent Application No. CN 201710831436.9 together with an English language translation.

* cited by examiner

IMAGE DISPLAY APPARATUS, IMAGE DISPLAY METHOD AND STORAGE MEDIUM

CROSS-REFERENCE TO RELATED APPLICATION

This application is based upon and claims the benefit of priority from the prior Japanese Patent Application No. 2016-185354, filed Sep. 23, 2016, the entire contents of which are incorporated herein by reference.

BACKGROUND OF THE INVENTION

1. Field of the Invention

The present invention relates to an image display apparatus, an image display method and a storage medium for displaying and moving a plurality of pointers based on time information (clock information).

2. Description of the Related Art

Conventionally, a technique has been known in which a display panel and a rendering function are effectively utilized by not only displaying and moving an hour hand (short hand) image and a minute hand (long hand) image but also changing the background color, as described in Japanese Patent Application Laid-Open (Kokai) Publication No. 2009-293960.

SUMMARY OF THE INVENTION

In accordance with one aspect of the present invention, there is provided an image display apparatus comprising: a processor; and a display, wherein the processor acquires sequentially-clocked time information, wherein the processor displays a plurality of pointer images indicating pointer movements on the display based on the time information, and displays a background image, wherein the processor identifies, in a display area of the display, a first area including display positions of the plurality of pointer images and a second area which is different from the first area, and wherein the processor controls to perform high-load and low-load display operations with different processing loads on the first area and the second area, respectively.

In accordance with another aspect of the present invention, there is provided an image display method for an image display apparatus including a processor and a display, comprising: acquiring sequentially-clocked time information; displaying a plurality of pointer images indicating pointer movements based on the time information; displaying a background image; identifying (i) a first area including display positions of the plurality of pointer images in a display area of the display and (ii) a second area which does not include the display positions of the plurality of pointer images and at least a portion of which displays the background image in the display area excluding the first area; and controlling to perform high-load and low-load display operations with different processing loads on the first area and the second area, respectively.

In accordance with another aspect of the present invention, there is provided a non-transitory computer-readable storage medium having stored thereon a program that is executable by a computer having a processor and a display to actualize functions comprising: processing for acquiring sequentially-clocked time information; processing for displaying a plurality of pointer images indicating pointer movements based on the time information, and displaying a background image; processing for identifying (i) a first area including display positions of the plurality of pointer images in a display area of the display and (ii) a second area which does not include the display positions of the plurality of pointer images and at least a portion of which displays the background image in the display area excluding the first area; and processing for controlling to perform high-load and low-load display operations with different processing loads on the first area and the second area, respectively.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

The present invention can be more clearly understood by the detailed description below being considered together with the following drawings.

DETAILED DESCRIPTION OF THE PREFERRED EMBODIMENTS

Embodiments of the present invention will hereinafter be described with reference to FIG. 1 to FIG. 7.

Figure 1:
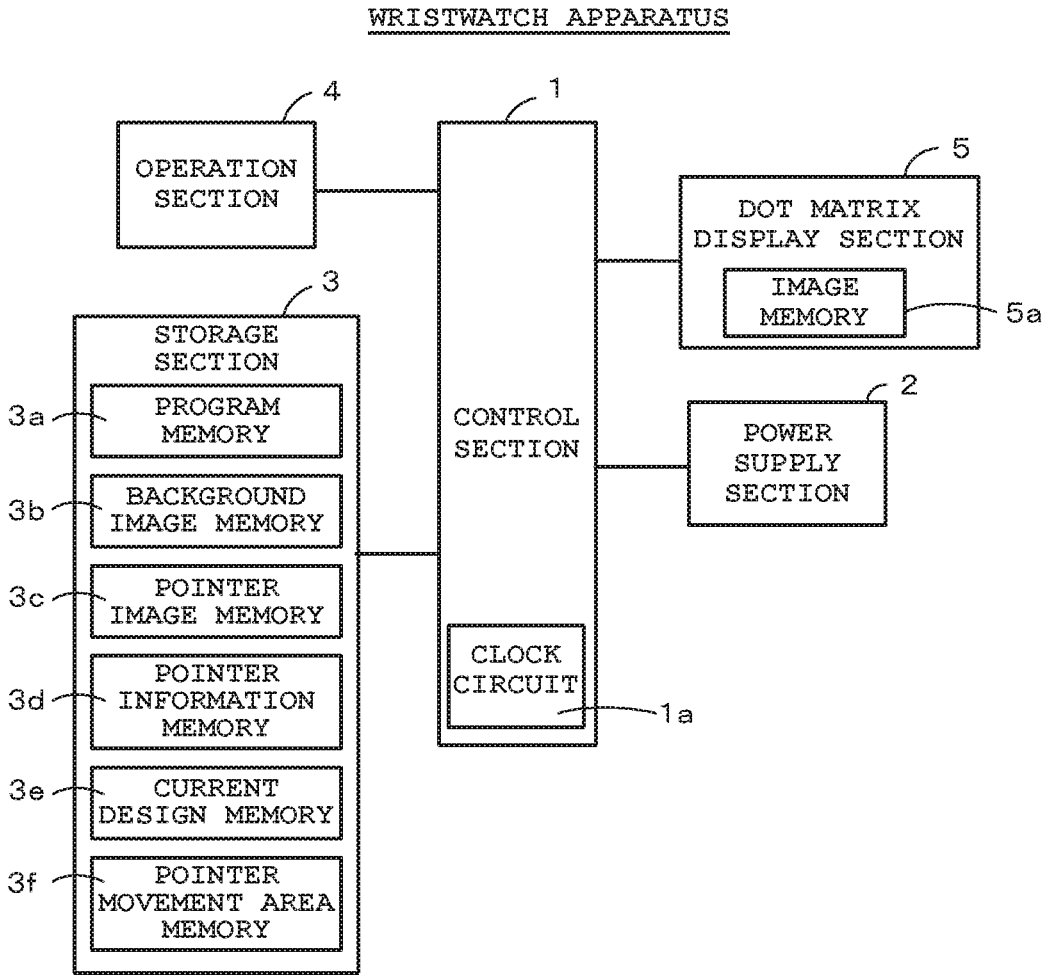
FIG. 1 is a block diagram showing basic components of a wristwatch apparatus in which the present invention has been applied as an image display apparatus.

The present embodiment is an example where the present invention has been applied in a wristwatch apparatus as an image display apparatus. FIG. 1 is a block diagram of basic components of the wristwatch apparatus.

This wristwatch apparatus, which displays and moves a plurality of pointers (analog timepiece display) based on time information (clock information), includes a control section 1, a power supply section 2, a storage section 3, an operation section 4, a dot matrix display section 5, and the like. The control section 1 operates by electric power supplied from the power supply section (secondary battery) 2, and controls the entire operation of the wristwatch apparatus in accordance with various programs in the storage section 3. This control section 1 includes a clock circuit 1*a* for sequentially acquiring clock information (year/month/day and hour/minute/second), in addition to a processor and a memory not shown.

The storage section 3 is structured by a ROM (Read Only Memory), a flash memory, and the like, and includes, for example, a background image memory 3*b*, a pointer image memory 3*c*, a pointer information memory 3*d*, a current design memory 3*e*, and a pointer movement area memory 3*f* for analog timepiece display, in addition to a program memory 3*a* having stored therein a program and various applications for achieving the present embodiment. The background image memory 3*b* is a memory that stores, as a library, plural types of background images with various designs each of which serves as a background such as a clock face when a plurality of pointers are displayed and moved. The pointer image memory 3*c* is a memory that stores, as a library, plural types of pointer images with different designs which correspond to a plurality of pointers (hour hand, minute hand and second hand). The pointer information memory 3*d* is a memory that stores, as information for controlling the movement of each pointer, information indicating that an hour hand is required to rotate once in twenty-four hours, information indicating that a minute hand is required to rotate once in sixty minutes, information indicating that a second hand is required to rotate once in sixty seconds, and the like.

The current design memory 3*e* is a memory that stores images (each pointer image and background image) of a current design as display targets for analog timepiece display. When images of a new design for analog timepiece display are generated, the current design memory 3*e* is overwritten with these images of the new design so as to update the images of the current design. That is, when images of an analog timepiece with a new design are generated using pointer images and a background image arbitrarily selected by a user operation from the background image memory 3*b* and the pointer image memory 3*c*, the current design memory 3*e* is overwritten with these generated images (each pointer image and background image) of the analog timepiece with the new design. The pointer movement area memory 3*f* is a memory that stores information regarding a pointer movement area identified by the display path (rotation path) of, among a plurality of pointers whose images have been stored in the current design memory 3*e* for analog timepiece display, the longest pointer (second hand) for one rotation being taken as a pointer movement area, and also stores various information (such as scanning directions) regarding this pointer movement area.

The operation section 4 includes, in addition to a power supply switch, basic operation keys (hardware keys) such as a timepiece mode change switch for switching between an analog timepiece display mode and a digital timepiece display mode. The dot matrix display section 5, which is a dot-matrix-type liquid-crystal display, includes a display screen where pixels have been arranged at intersection points of a plurality of signal lines and a plurality of scanning lines in a matrix form, and an image memory 5*a* with addresses corresponding to the pixels of this display screen. By each pixel being scanned by a horizontal synchronizing signal and a vertical synchronizing signal, an image for one frame (one screen) is displayed. In the present embodiment, one of the four corners of the quadrangular display screen is taken as a scanning start point, and its opposing corner is taken as a scanning end point, whereby horizontal scanning from a left-to-right direction or a right-to-left direction and vertical scanning from a top-to-bottom direction or a bottom-to-top direction can be performed. Also, each point (pixel) on this quadrangular display screen is represented by XY coordinate values in a plane coordinate system where, for example, a horizontal scanning direction is taken as an X axis, a vertical scanning direction is taken as an Y axis, and an upper-left corner is taken as the starting point.

Figure 2A:
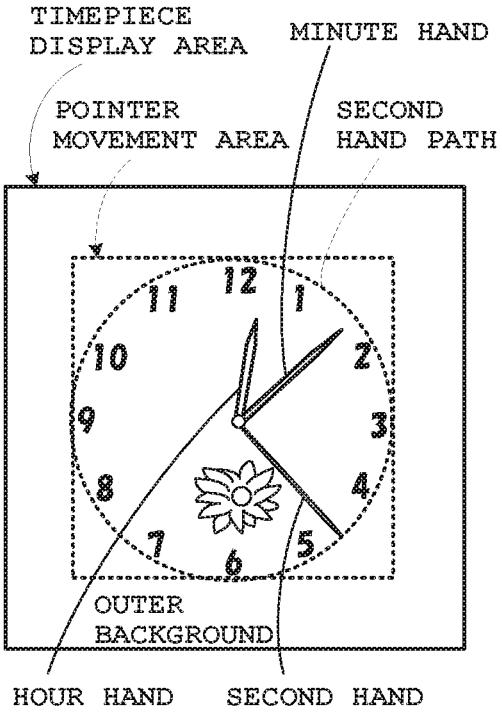
FIG. 2A is a diagram showing an example of analog timepiece display and various images serving as elements of the timepiece display.
Figure 2B:
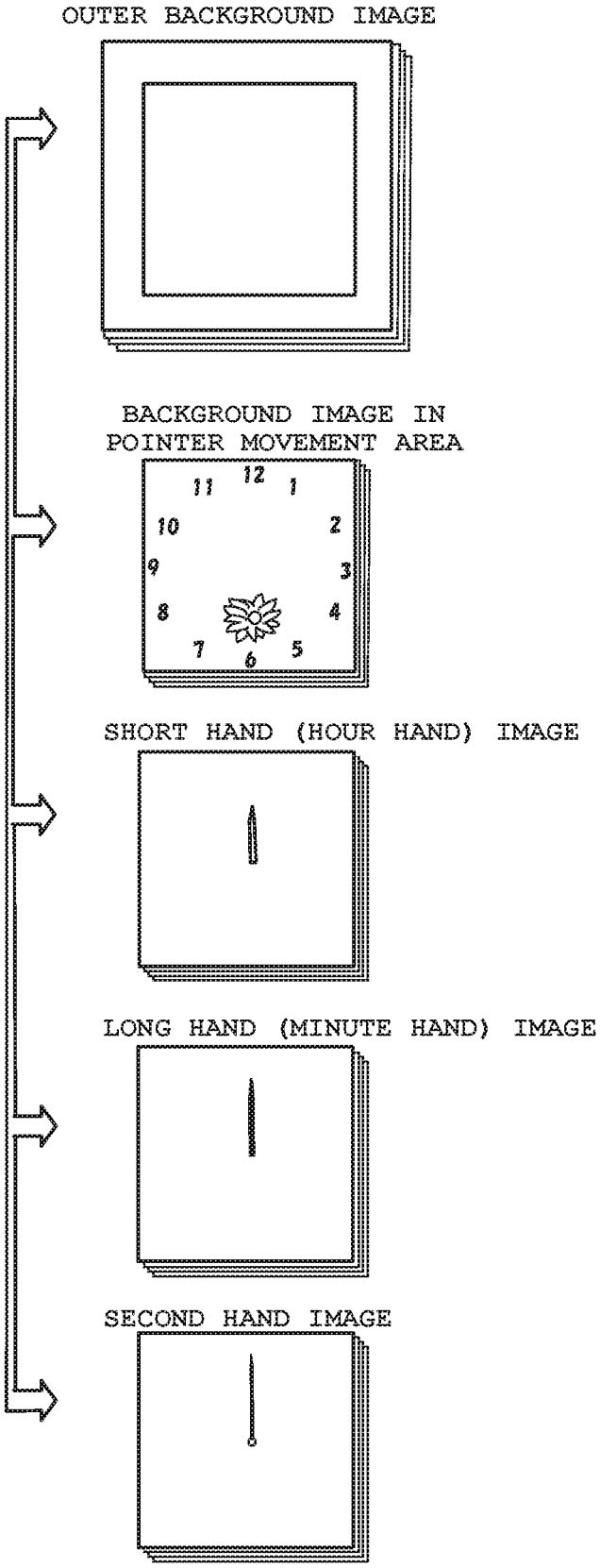
FIG. 2B is a diagram showing an example of analog timepiece display and various images serving as elements of the timepiece display.

FIG. 2A and FIG. 2B are diagrams showing an example of analog timepiece display and various images serving as elements of the timepiece display.

FIG. 2A shows an example of analog timepiece display when an hour hand, a minute hand, and a second hand serving as a plurality of pointers are shown on the dot matrix display section 5 by analog display. That is, in the present embodiment, when the entire screen or a partial area of the dot matrix display section 5 is taken as a timepiece display area, a second hand path (circular rotation path) when the longest pointer (second hand) among the plurality of pointers is rotated once around its rotation axis in the timepiece display area is determined, a square virtual area circumscribed around this circular second hand path is identified as a pointer movement area, and information regarding this pointer movement area (for example, upper-left coordinates and upper-right coordinates) is stored in the pointer movement area memory 3*f*. In addition, based on this pointer movement area, its entire outside area is identified as an outer background area, and a predetermined background (omitted in the drawing) is fixedly displayed thereon as a still image. Examples of the outer background include a color background with some pattern. This outer background may be arbitrarily changed by a user operation, or may be changed for each predetermined period (for example, by the seasons).

As such, in the present embodiment, in order to efficiently perform a display operation for analog display on the dot matrix display section 5, the entire timepiece display area is divided into two areas (pointer movement area and outer background area), and high-load and low-load display operations with different processing loads (for example, processing amount or processing time, which applies hereinafter) are performed on the pointer movement area and the outer background area, respectively. That is, a relatively high-load display operation (a display operation requiring a long processing time) for controlling, at every pointer movement timing, the display positions of a plurality of pointer images which change with time in accordance with time information is performed on the pointer movement area, and a relatively low-load display operation (a display operation requiring only a short processing time) for displaying a background image at timing (timing when a current mode is switched to an analog timepiece mode in the present embodiment) that comes at intervals longer than those of the pointer movement timing is performed on the outer background area.

FIG. 2B shows various images serving as elements of the analog timepiece display shown in FIG. 2A. These various images include an outer background image that is displayed outside a pointer movement area, and a background image, an hour hand image, a minute hand image, and a second hand image that are displayed in the pointer movement area. The above-described background image memory 3*b* stores, in addition to a plurality of outer background images that are displayed outside a pointer movement area, a plurality of various background images with different designs, such as the background image of the clock face shown in FIG. 2B. Then, from among the groups of background images, images arbitrarily selected by user operations are displayed as backgrounds inside and outside a pointer movement area. These inner and outer background images include still images that are fixedly displayed, and images that are gradually varied with time in accordance with the movement timing of a predetermined pointer, such as an image of a flower bud that gradually blooms in conjunction with the movement of a minute hand or an hour hand. That is, although the outer background image of the present embodiment is a still image as described above, it may be a moving image. Also, the background image of the present embodiment which is displayed in a pointer movement area is not limited to a still image, and may be a moving image that is varied in conjunction with a minute hand or an hour hand.

The pointer image memory 3*c* stores, in addition to the pointer images shown in FIG. 2B, various pointer images with different designs. Then, from among the group of pointer images, images arbitrarily selected by user operations are displayed in a pointer movement area as pointers. As such, in the present embodiment, an arbitrary background image, an arbitrary hour hand image, an arbitrary minute hand image, and an arbitrary secondhand image selected by user operations are combined, whereby images of an analog timepiece with a new design can be generated and displayed. Note that these images of an analog timepiece with a new design may be generated by, instead of user operations being performed, a change in season or the like being detected, and a background image, an hour hand image, a minute hand image, and a second hand image being automatically combined at the detection timing.

FIG. 3A, FIG. 3B, FIG. 3C and FIG. 3D are diagrams outlining an operation for displaying an analog timepiece while scanning each pixel constituting a pointer movement area.

When sequentially scanning pixels constituting a pointer movement area in predetermined directions, that is, an horizontal scanning direction (X axis direction) and a vertical scanning direction (Y axis direction) under control by the control section 1 in response to an horizontal synchronizing signal and a vertical synchronizing signal, the dot matrix display section 5 performs scanning while judging, at every pointer movement timing, whether a current scanning point (pixel) is a point (pixel) where one of a plurality of pointers is displayed or is a point (pixel) where a background is displayed. Here, the dot matrix display section 5 sequentially judges whether the current point is a point where a secondhand is displayed, whether the current point is a point where a minute hand is displayed, whether the current point is a point where an hour hand is displayed, and whether the current point is a point where a background is displayed. Then, based on the judgment result, the dot matrix display section 5 performs a display operation for displaying an image (second hand image, minute hand image, hour hand image, or background image) of a type corresponding to that scanning point.

Figure 3A:
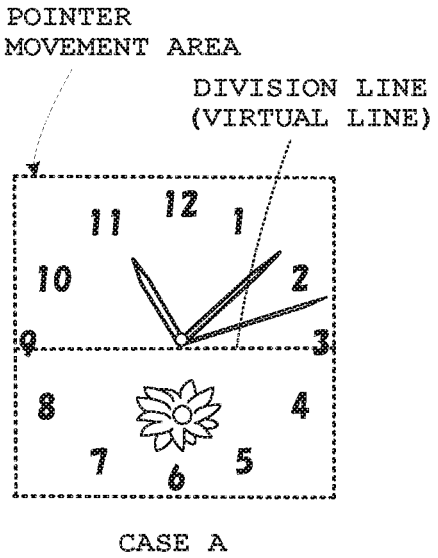
FIG. 3A is a diagram outlining an operation for displaying an analog timepiece while scanning each pixel in a pointer movement area identified in a timepiece display area.

In order to efficiently perform this display operation in a pointer movement area, in the present embodiment, when the display positions of a plurality of pointers that are changed with time in accordance with time information are all within (concentrated in) one area of segment areas acquired by conceptually (virtually) dividing the pointer movement area, this segment area is identified as a pointer presence area, and all of the other segment areas except this pointer presence area are identified as pointer absence areas. These pointer presence and pointer absence areas are subjected to high-load and low-load display operations with different processing loads, respectively. In FIG. 3A where the entire pointer movement area has been conceptually divided into an upper area and a lower area in a vertical direction, the display positions of all pointers are within (concentrated in) the upper area (case A). Note that, in consideration of the shape and thickness of each pointer, the line (virtual line) dividing the entire pointer movement area into the upper area and the lower area has been set to be positioned slightly (for example, by a dot width equal to several dots+½ of the thickness of each pointer) lower than a line dividing the entire pointer movement area into two equal areas in the vertical direction, whereby a relation has been established in which the upper area is larger than the lower area.

Figure 3B:
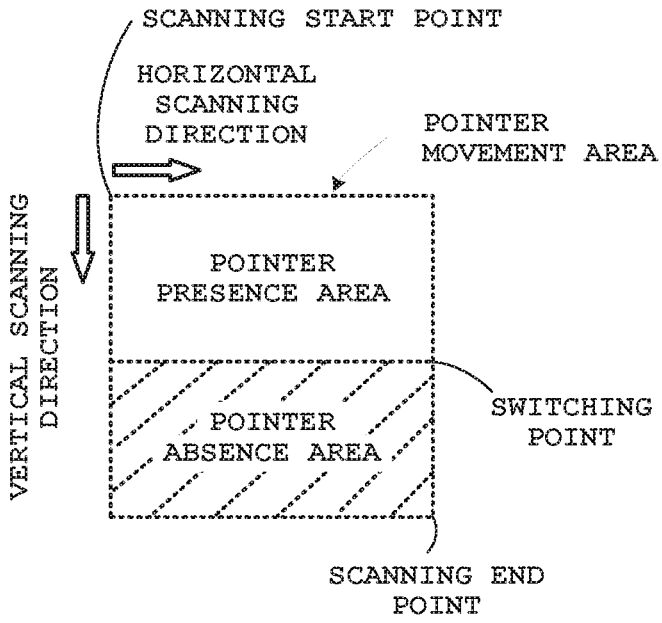
FIG. 3B is a diagram outlining the operation for displaying the analog timepiece while scanning each pixel in the pointer movement area identified in the timepiece display area.

In FIG. 3B, the upper area and the lower area acquired by the entire pointer movement area being conceptually divided in FIG. 3A have been taken as a pointer presence area a pointer absence area, respectively. Here, the upper area is taken as a pointer presence area because it is an area where the pointers and a background have been superimposed and displayed, and the lower area is taken as a pointer absence area because it is an area where no pointer has been displayed and only the background has been displayed. These pointer presence and pointer absence areas are changed with time based on time information (which applies hereinafter). Note that, since the upper area is larger than the lower area, that is, the pointer presence area is larger than the pointer absence area, each pointer can be prevented from not being displayed on the boundary between the pointer presence area and the pointer absence area (which applies hereinafter).

Then, the pointer presence area and the pointer absence area are subjected to high-load and low-load display operations with different processing loads, respectively. That is, for the pointer presence area, it is judged at every pointer movement timing whether a current scanning point is a point (pixel) where one of the plurality of pointers is displayed or is a point (pixel) where the background is displayed. Subsequently, based on the judgment result, a relatively high-load display operation for displaying an image of a type corresponding to that point (a display operation requiring a long processing time) is performed. For the pointer absence area, the above-described judging operation at every pointer movement timing is omitted, and a relatively low-load display operation for displaying a background image (a display operation requiring only a short processing time) is performed.

In this case, when the entire pointer movement area is to be scanned, the pointer presence area is first scanned, and then the pointer absence area is scanned. For this reason, the upper-left corner of the pointer movement area is taken as a scanning start point, and the lower-right corner thereof is taken as a scanning end point. Also, the rightward direction is taken as a horizontal scanning direction in the pointer movement area, and the downward direction is taken as a vertical scanning direction. Furthermore, an end point of the pointer presence area is detected as a point to switch to the pointer absence area. Then, the scanning start point, the scanning end point, the horizontal scanning direction, the vertical scanning direction, and the area switching point (the endpoint of the pointer presence area) are temporarily stored in the pointer movement area memory 3*f* as information regarding the pointer movement area.

Figure 3C:
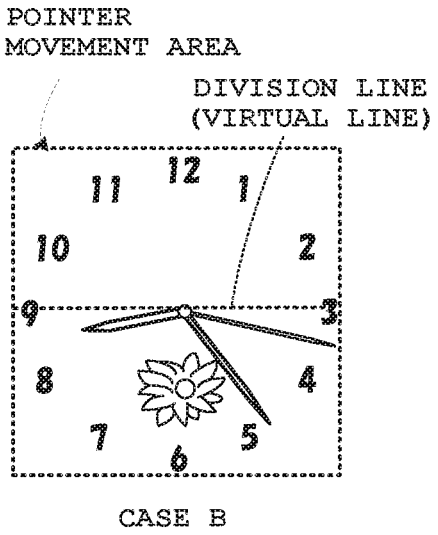
FIG. 3C is a diagram outlining an operation for displaying an analog timepiece while scanning each pixel in a pointer movement area identified in a timepiece display area.
Figure 3D:
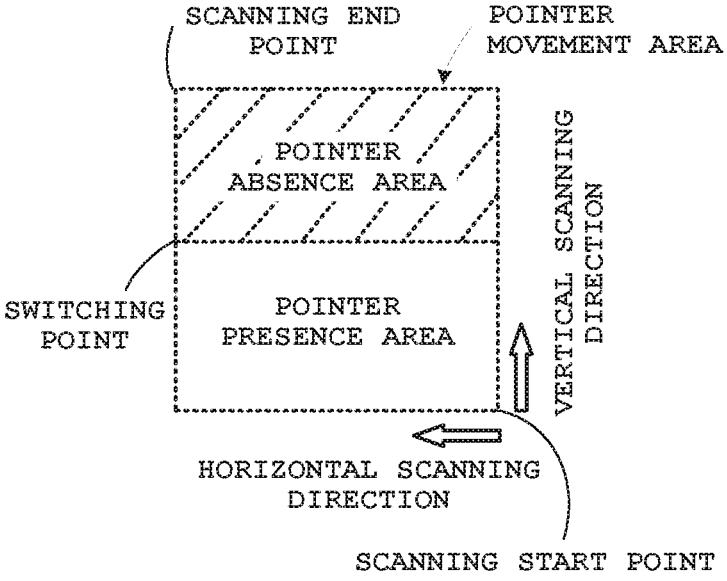
FIG. 3D is a diagram outlining the operation for displaying the analog timepiece while scanning each pixel in the pointer movement area identified in the timepiece display area.

In FIG. 3C where the entire pointer movement area has been conceptually divided into an upper area and a lower area in a vertical direction, the display positions of all pointers are within (concentrated in) the lower area (case B). In this case as well, in consideration of the shape and thickness of each pointer, the line (virtual line) dividing the entire pointer movement area into the upper area and the lower area has been set to be positioned slightly higher than a line dividing the entire pointer movement area into two equal areas in the vertical direction, whereby a relation has been established in which the upper area is smaller than the lower area. In FIG. 3D, the lower area is taken as a pointer presence area and the upper area is taken as a pointer absence area. Then, as with the above-described case, the pointer presence area and the pointer absence area are subjected to high-load and low-load display operations with different processing loads, respectively.

In this case, since the pointer presence area is first scanned and then the pointer absence area is scanned, the lower-right corner of the pointer movement area is taken as a scanning start point, and the upper-left corner thereof is taken as a scanning end point. Also, the leftward direction is taken as a horizontal scanning direction in the pointer movement area, and the upward direction is taken as a vertical scanning direction. Furthermore, an endpoint of the pointer presence area is detected as a point to switch to the pointer absence area. Then, the scanning start point, the scanning end point, the horizontal scanning direction, the vertical scanning direction, and the area switching point are temporarily stored in the pointer movement area memory 3*f* as information regarding the pointer movement area.

Figure 4A:
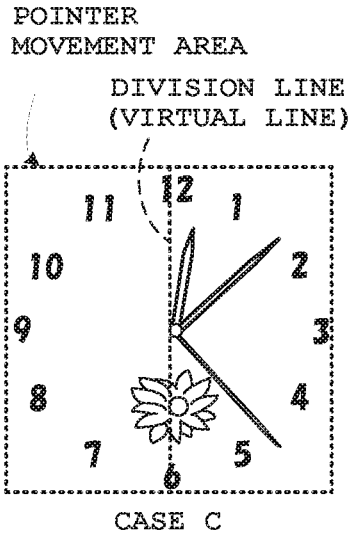
FIG. 4A is a diagram outlining an operation for displaying an analog timepiece while scanning each pixel in a pointer movement area identified in a timepiece display area.

FIG. 4A, FIG. 4B, FIG. 4C and FIG. 4D are diagrams outlining an operation for displaying an analog timepiece while scanning each pixel constituting a pointer movement area. In FIG. 4A where the entire pointer movement area has been conceptually divided into a right area and a left area in a horizontal direction, the display positions of all pointers are within (concentrated in) the right area (case C). In this case as well, in consideration of the shape and thickness of each pointer, the line (virtual line) dividing the entire pointer movement area into the right area and the left area has been set to be positioned slightly shifted to left from a line dividing the pointer movement area into two equal areas in the horizontal direction, whereby a relation has been established in which the right area is larger than the left area.

Figure 4B:
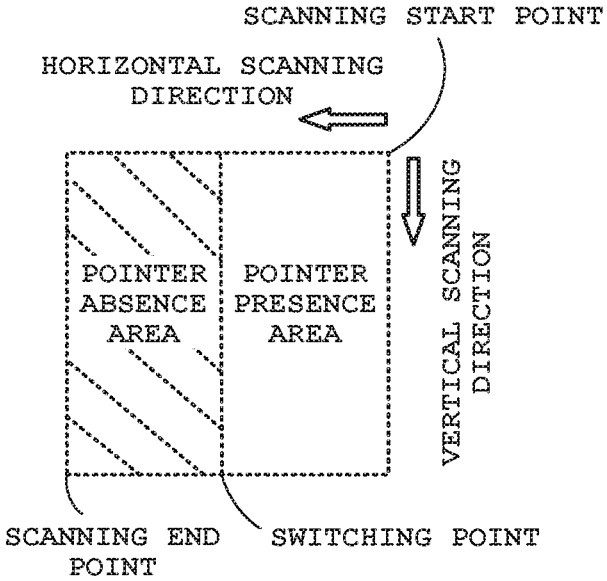
FIG. 4B is a diagram outlining the operation for displaying the analog timepiece while scanning each pixel in the pointer movement area identified in the timepiece display area.

In FIG. 4B, the right area is taken as a pointer presence area and the left area is taken as a pointer absence area. Then, as with the case described above, the pointer presence area and the pointer absence area are subjected to high-load and low-load display operations with different processing loads, respectively. In this case, since the pointer presence area is first scanned and then the pointer absence area is scanned, the upper-right corner of the pointer movement area is taken as a scanning start point, the lower-left corner is taken as a scanning end point, the leftward direction is taken as a horizontal scanning direction in the pointer movement area, the downward direction is taken as a vertical scanning direction, and an end point of the pointer presence area is detected as a point to switch to the pointer absence area. Then, the scanning start point, the scanning end point, the horizontal scanning direction, the vertical scanning direction, and the area switching point are temporarily stored in the pointer movement area memory 3*f* as information regarding the pointer movement area.

Figure 4C:
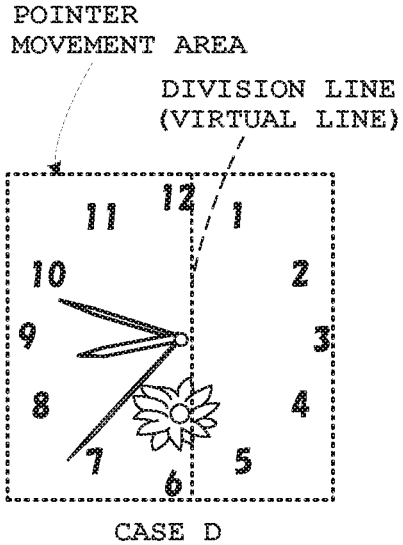
FIG. 4C is a diagram outlining an operation for displaying an analog timepiece while scanning each pixel in a pointer movement area identified in a timepiece display area.
Figure 4D:
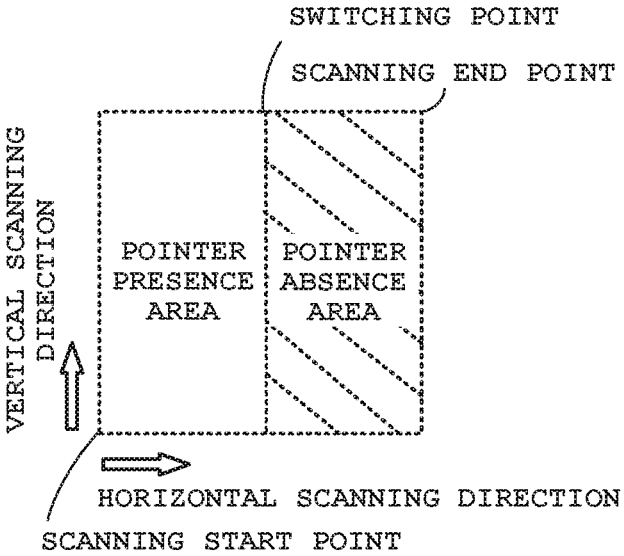
FIG. 4D is a diagram outlining the operation for displaying the analog timepiece while scanning each pixel in the pointer movement area identified in the timepiece display area.

In FIG. 4C, the display positions of all pointers are within (concentrated in) a left area (case D). In this case as well, in consideration of the shape and thickness of each pointer, the line (virtual line) dividing the entire pointer movement area into the right area and the left area has been set to be positioned slightly shifted to right from a line dividing the pointer movement area into two equal areas in the horizontal direction, whereby a relation has been established in which the right area is smaller than the left area. In FIG. 4D, the left area is taken as a pointer presence area and the right area is taken as a pointer absence area. Then, as with the above-described case, the pointer presence area and the pointer absence area are subjected to high-load and low-load display operations with different processing loads, respectively.

In this case, since the pointer presence area is first scanned and then the pointer absence area is scanned, the lower-left corner of the pointer movement area is taken as a scanning start point, the upper-right corner is taken as a scanning end point, the rightward direction is taken as a horizontal scanning direction in the pointer movement area, the upward direction is taken as a vertical scanning direction, and an end point of the pointer presence area is detected as a point to switch to the pointer absence area. Then, the scanning start point, the scanning end point, the horizontal scanning direction, the vertical scanning direction, and the area switching point are temporarily stored in the pointer movement area memory 3*f* as information regarding the pointer movement area.

As described above, in the present embodiment, when displaying and moving a plurality of pointer images based on time information and also displaying a background image in a timepiece display area on the dot matrix display section 5, the control section 1 identifies an area where the plurality of pointer images are displayed (a pointer movement area or a pointer presence area in the pointer movement area), and controls to perform high-load and low-load display operations with different processing loads on the identified area and the area other than the identified area (an area outside the pointer movement area or a pointer absence area in the pointer movement area), respectively.

That is, in the present embodiment, the entire timepiece display area is divided into two areas, and a first area (pointer movement area) including the display positions of pointer images are identified. In addition, in the display area other than this first area, a second area (outer background area) is identified which does not include the display positions of the pointer images and at least a portion of which displays a background image. Also, in the pointer movement area as well, a first area (pointer presence area) including the display positions of the pointer images is identified. In addition, in the display area other than this first area, a second area (pointer absence area) is identified which does not include the display positions of the pointer images and at least a portion of which displays a background image. Then, high-load and low-load display operations with different processing loads are performed on the first area (the pointer movement area or the pointer presence area in the pointer movement area) and the second area (the area outside the pointer movement area or the pointer absence area in the pointer movement area), respectively.

Figure 5:
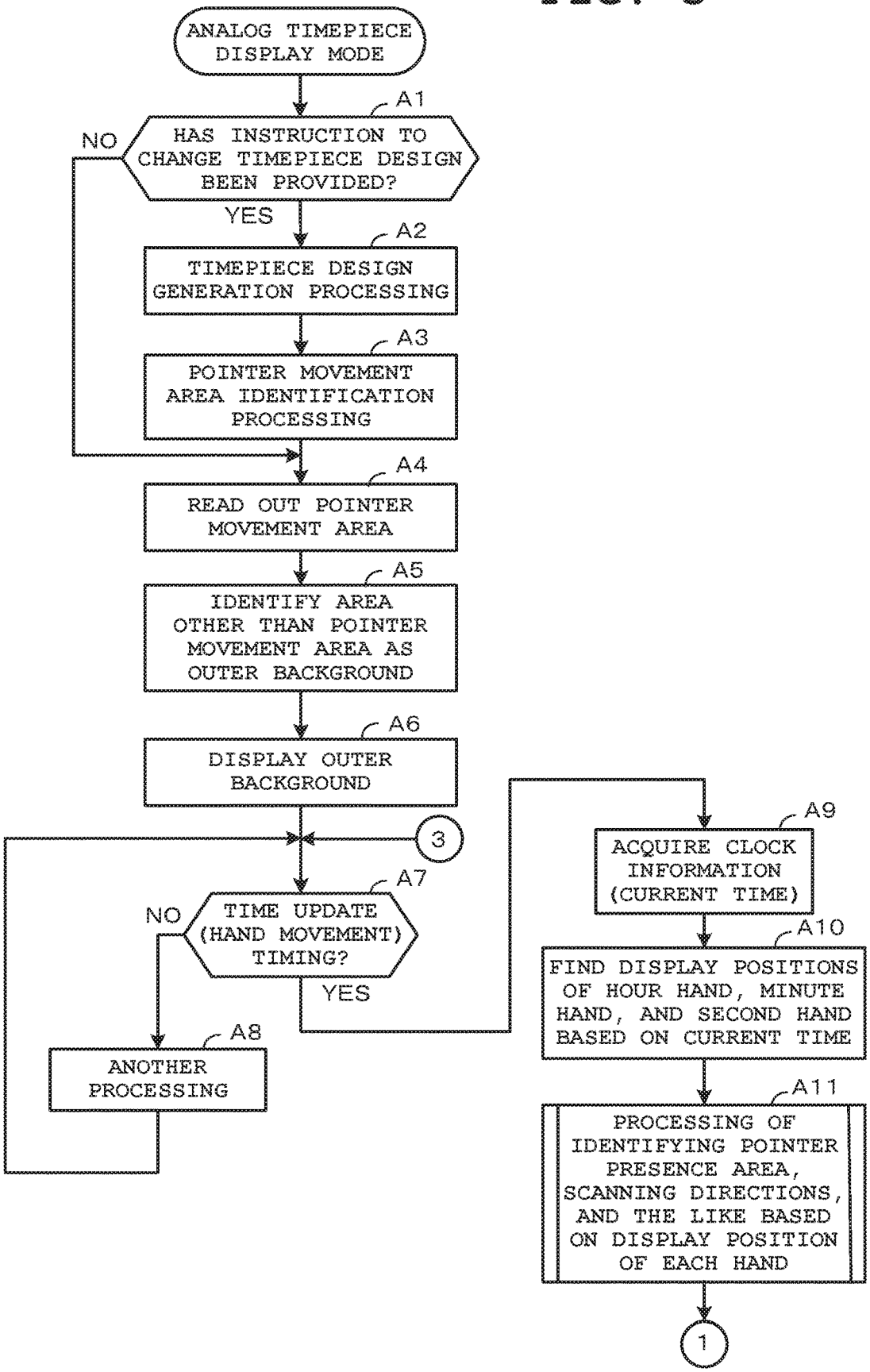
FIG. 5 is a flowchart of an operation that is started when a current mode is switched to an analog timepiece display mode.
Figure 6:
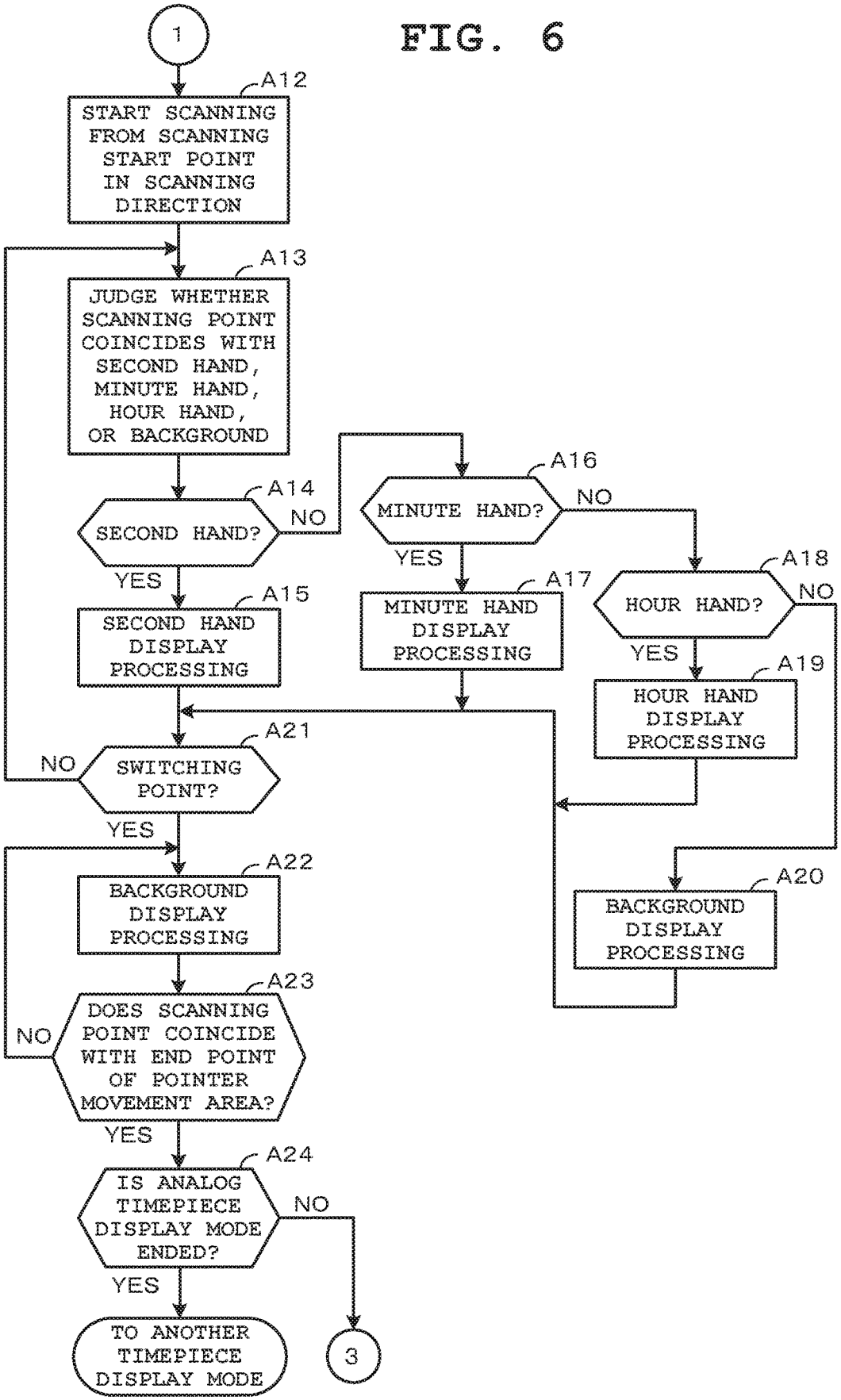
FIG. 6 is a flowchart of an operation following that of FIG. 5.

Next, the operation concept of the wristwatch apparatus in the present embodiment is described with reference to flowcharts shown in FIG. 5 to FIG. 7. Here, each function described in these flowcharts is stored in a readable program code format, and operations based on these program codes are sequentially performed. Also, operations based on the above-described program codes transmitted over a transmission medium such as a network can also be sequentially performed. That is, the unique operations of the present embodiment can be performed using programs and data supplied from an outside source over a transmission medium, in addition to a recording medium. FIG. 5 and FIG. 6 are flowcharts outlining the operation of the characteristic portion of the present embodiment from among all of the operations of the wristwatch apparatus. After exiting the flows of FIG. 5 and FIG. 6, the control section 1 returns to the main flow (omitted in the drawings) of the overall operation.

FIG. 5 and FIG. 6 are flowcharts of an operation to be started when a current mode is switched to the analog timepiece display mode.

First, when a current mode is switched to the analog timepiece display mode, the control section 1 judges whether an instruction to change the design of analog timepiece display has been provided (Step A1 of FIG. 5). This design change instruction is to change the shape, pattern, color, and the like of pointer images and a background image, and may be provided not only when a user operation is performed but also when a change of seasons or the like is detected.

When judged that an instruction to change the design of analog timepiece display has not been provided (NO at Step A1), the control section 1 proceeds to Step A4 described below. Conversely, when judged that an instruction to change the design has been provided (YES at Step A1), the control section 1 performs processing of generating images of a new timepiece design in response to the change instruction (Step A2). More specifically, the control section 1 generates images of a new timepiece design by combining a background image, an hour hand image, a minute hand image, and a second hand image of a design selectively read out by a user operation from the background image memory 3*b* and the pointer image memory 3*c* for analog timepiece display, and overwrites and rewrites the current design memory 3*e* with the images of the new timepiece design.

After generating the images of the new timepiece design as described above, the control section 1 determines a second hand path (circular rotation path) that is acquired by the longest pointer (for example, the second hand) being rotated once around its rotation axis, identifies a square virtual frame circumscribed around this circular second hand path as a pointer movement area, and overwrites the pointer movement area memory 3*f* with information regarding this pointer movement area (for example, upper-left coordinates and upper-right coordinates) (Step A3). Then, the control section 1 proceeds to the next Step A4. Note that the method of identifying a pointer movement area is not limited to the above-described method where a pointer movement area is identified based on a rotation path rendered by a pointer being rotated once, and an arbitrary method may be adopted for identifying a pointer movement area. For example, a method may be adopted in which the radius of a circle centering on the rotation axis of the longest pointer is found and a pointer movement area is calculated and identified based on this radius.

The processing at Step A4 is to readout a pointer movement area from the pointer movement area memory 3*f*. That is, at Step A1, when judged that a design change instruction has not been provided (NO at Step A1), the control section 1 reads out a pointer movement area stored corresponding to the images of the current timepiece design. However, when judged that a timepiece design change instruction has been provided (YES at Step A1), the control section 1 reads out a pointer movement area stored corresponding to the new timepiece design. Next, in the timepiece display area of the dot matrix display section 5, the control section 1 identifies, based on the read pointer movement area, the entire outside area of the pointer movement area as an outer background area (Step A5), and causes a predetermined background image to be displayed in this outer background area (Step A6). In the present embodiment, this outer background image is not a moving image that changes with time but a still image that is fixedly displayed. Accordingly, an operation of displaying a moving image in the pointer movement area and an operation of displaying the outer background are separately performed.

Next, the control section 1 proceeds to Step A7, and judges whether time update (pointer movement) timing (which comes at, for example, an interval of one second) has come. When judged that pointer movement timing has not come (NO at Step A7), the control section 1 performs, as another processing, processing in accordance with the user's instruction (for example, time adjustment processing) after receiving a user operation (Step A8). Conversely, when judged that pointer movement timing has come (YES at Step A7), the control section 1 acquires current time information (clock information) from the clock circuit 1*a* (Step A9), and acquires the display positions of the hour hand, the minute hand, and the second hand from this current time information (Step A10). For example, in a plane coordinate system where the upper-left corner of the pointer movement area is taken as an origin, the control section 1 acquires the coordinates of abase end, a tip end, or a midpoint of each hand as the display position of each of the hour hand, the minute hand, and the second hand. Then, the control section 1 proceeds to processing of identifying a pointer presence area and a pointer absence area in the pointer movement area and identifying directions of scanning the pointer movement area based on whether the display positions of the hands are all within one area in the vertical direction or are within one area in the horizontal direction in the pointer movement area (Step A11).

Figure 7:
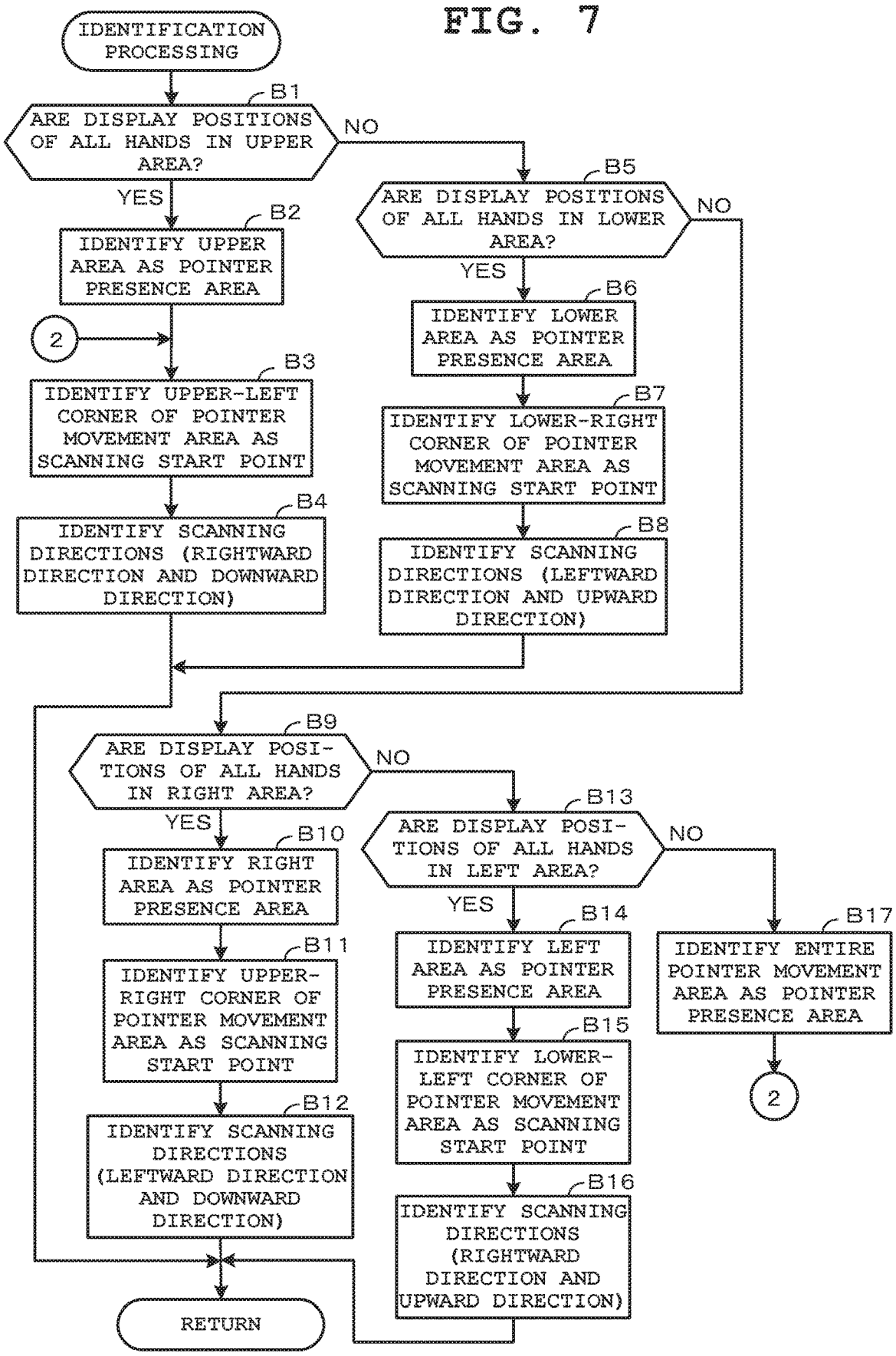
FIG. 7 is a flowchart for describing details of processing of identifying a pointer presence area, a pointer absence area, and scanning directions (Step A11 of FIG. 5)

FIG. 7 is a flowchart for describing details of the processing of identifying a pointer presence area, a pointer absence area, and scanning directions (Step A11 of FIG. 5).

First, the control section 1 conceptually divides the entire pointer movement area into an upper area and a lower area in the vertical direction or a right area and a left area in the horizontal direction, and then judges to which of the above-described cases A to D the display positions of all the hands apply. That is, the control section 1 judges whether the display positions of the hands are all within (concentrated in) the upper area (Step B1), judges whether they are all within the lower area (Step B5), judges whether they are all within the right area (Step B9), and judges whether they are all within the left area (Step B13).

For example, if the time information indicates "11:8:12" as shown in FIG. 3A or "2:10:50" and therefore the display positions of all the hands are within the upper area (case A) (YES at Step B1), the control section 1 identifies the upper area as a pointer presence area, identifies the area (lower area) other than the upper area as a pointer absence area, identifies an endpoint of the pointer presence area as a point to switch to the pointer absence area as shown in FIG. 3B, and temporarily stores the pointer presence area, the pointer absence area, and the switching point in the pointer movement area memory 3*f* as information regarding the pointer movement area (Step B2). Then, the control section 1 identifies the upper-left corner of the pointer movement area as a scanning start point and the lower-right corner thereof as a scanning end point (Step B3), identifies the rightward direction as a horizontal scanning direction in the pointer movement area and the downward direction as a vertical scanning direction, and temporarily stores the scanning start point, the scanning end point, the horizontal scanning direction, and the vertical scanning direction in the pointer movement area memory 3*f* as information regarding the pointer movement area (Step B4).

For example, if the time information indicates "8:24:17" as shown in FIG. 3C or "4:40:30" and therefore the display positions of all the hands are within the lower area (case B) (YES at Step B5), the control section 1 identifies the lower area as a pointer presence area, identifies the area (upper area) other than the lower area as a pointer absence area, identifies an endpoint of the pointer presence area as a point to switch to the pointer absence area as shown in FIG. 3D, and temporarily stores the pointer presence area, the pointer absence area, and the switching point in the pointer movement area memory 3*f* as information regarding the pointer movement area (Step B6). Then, the control section 1 identifies the lower-right corner of the pointer movement area as a scanning start point and the upper-left corner thereof as a scanning end point (Step B7), identifies the leftward direction as a horizontal scanning direction in the pointer movement area and the upward direction as a vertical scanning direction, and temporarily stores the scanning start point, the scanning end point, the horizontal scanning direction, and the vertical scanning direction in the pointer movement area memory 3*f* as information regarding the pointer movement area (Step B8).

For example, if the time information indicates "12:08:23" as shown in FIG. 4A or "5:25:15" and therefore the display positions of all the hands are within the right area (case C) (YES at Step B9), the control section 1 identifies the right area as a pointer presence area, identifies the area (left area) other than the right area as a pointer absence area, identifies an endpoint of the pointer presence area as a point to switch to the pointer absence area as shown in FIG. 4B, and temporarily stores the pointer presence area, the pointer absence area, and the switching point in the pointer movement area memory 3*f* as information regarding the pointer movement area (Step B10). Then, the control section 1 identifies the upper-right corner of the pointer movement area as a scanning start point and the lower-left corner thereof as a scanning end point (Step B11), identifies the leftward direction as a horizontal scanning direction in the pointer movement area and the downward direction as a vertical scanning direction, and temporarily stores the scanning start point, the scanning end point, the horizontal scanning direction, and the vertical scanning direction in the pointer movement area memory 3*f* as information regarding the pointer movement area (Step B12).

For example, if the time information indicates "8:49:36" as shown in FIG. 4C or "11:45:55" and therefore the display positions of all the hands are within the left area (case D) (YES at Step B13), the control section 1 identifies the left area as a pointer presence area, identifies the area (right area) other than the left area as a pointer absence area, identifies an endpoint of the pointer presence area as a point to switch to the pointer absence area as shown in FIG. 4D, and temporarily stores the pointer presence area, the pointer absence area, and the switching point in the pointer movement area memory 3*f* as information regarding the pointer movement area (Step B14). Then, the control section 1 identifies the lower-left corner of the pointer movement area as a scanning start point and the upper-right corner thereof as a scanning end point (Step B15), identifies the rightward direction as a horizontal scanning direction in the pointer movement area and the upward direction as a vertical scanning direction, and temporarily stores the scanning start point, the scanning end point, the horizontal scanning direction, and the vertical scanning direction in the pointer movement area memory 3*f* as information regarding the pointer movement area (Step B16).

On the other hand, for example, if the time information indicates "12:40:10" or "10:25:40" and therefore the display positions of the hands are dispersedly positioned in the pointer movement area, that is, if not all the display positions are within one of the upper area, the lower area, the right area, and the left area (a case other than cases A to D) (NO at Step B13), the control section 1 identifies the entire pointer movement area as a pointer presence area (Step B17). Then, the control section 1 proceeds to the next Step B3 described above, identifies the upper-right corner of the pointer movement area as a scanning start point and the lower-left corner thereof as a scanning end point, identifies the leftward direction as a horizontal scanning direction in the pointer movement area and the downward direction as a vertical scanning direction, and temporarily stores the scanning start point, the scanning end point, the horizontal scanning direction, and the vertical scanning direction in the pointer movement area memory 3*f* as information regarding the pointer movement area (Step B4).

When the above-described processing of identifying a pointer presence area, a pointer absence area, and scanning directions (Step A11 of FIG. 5) is ended, the control section 1 proceeds to the flow of FIG. 6 and starts, based on the information regarding the pointer movement area temporarily stored in the pointer movement area memory 3*f*, an operation of sequentially scanning pixels in an area defined by the scanning start point and the scanning end point in directions indicated by the horizontal scanning direction and the vertical scanning direction (Step A12). During this scanning operation, the control section 1 judges whether a current scanning point (pixel) coincides with the display position of the second hand, whether it coincides with the display position of the minute hand, whether it coincides with the display position of the hour hand, and whether it coincides with the display position of the background (Step A13).

When judged that the current scanning point (pixel) coincides with the display position of the second hand (YES at Step A14), the control section 1 causes the secondhand image to be displayed at that position irrespective of the display positions the other hands (Step A15). When judged that the current scanning point coincides with the display position of not the second hand but the minute hand (YES at Step A16), the control section 1 causes the minute hand image to be displayed at that position (Step A17). When judged that the current scanning point coincides with the display position of not the minute hand but the hour hand (YES at Step A18), the control section 1 causes the hour hand image to be displayed at that position (Step A19). When judged that the current scanning point does not coincides with any of the second hand, the minute hand, and the hour hand (NO at Step A18), the control section 1 causes the background image to be displayed at that position (Step A20). When the above-described display for one pixel is ended, the control section 1 proceeds to Step A21, and judges whether the current scanning point (pixel) is the area switching point (the end point of the pointer presence area). When judged that it is not the area switching point (NO at Step A21), the control section 1 returns to Step A12 described above to repeat the above-described display operation.

Here, when judged that the current scanning point (pixel) is the switching point, that is, the display operation on the pointer presence area has been completed (YES at Step A21), the control section 1 performs an operation of displaying the background image (Step A22) without performing the above-described judgment processing (Step A13, Step A14, Step A16, and Step A18). Then, the control section 1 judges whether the current scanning point (pixel) is the scanning end point (Step A23) and, when judged that it is not the scanning end point (NO at Step A23), returns to Step A22 described above to repeat the operation for displaying the background image.

Here, when the current scanning point is the scanning end point and therefore the display operation on the pointer absence area is completed (YES at Step A23), the control section 1 judges whether the analog timepiece display mode is ended (Step A24). When the analog timepiece display mode is not ended (NO at Step A24), the control section 1 returns to Step A7 of FIG. 5. When the analog timepiece display mode is cancelled and switched to another timepiece display mode (YES at Step A24), the control section 1 proceeds to processing in the other timepiece display mode (digital timepiece mode).

As such, in the present embodiment, the control section 1 performs the above-described control in addition to displaying and moving a plurality of pointer images based on time information acquired from the clock circuit 1*a*. That is, first, a first area including the display positions of the pointer images are identified in the display area of the display section 5. Also, in the display area other than this first area, a second area is identified which does not include the display positions of the pointer images and at least a portion of which displays a background image. Then, high-load and low-load display operations with different processing loads are performed on the first area and the second area, respectively. This control can prevent an increase in a processing load due to the display and movement of pointer images and the display of a background image.

Also, in the present embodiment, based on the rotation path of the longest pointer of a plurality of pointers, the control section 1 identifies an area in a timepiece display area where images of the plurality of pointers are displayed, as a pointer movement area; identifies an area outside the pointer movement area as an outer background area where a background image is displayed; and performs high-load and low-load display operations with different processing loads on the pointer movement area and the outer background area, respectively. This control allows display operations to be separately controlled for a pointer movement area and an outer area, whereby the entire display can be efficiently performed.

Moreover, in the present embodiment, the control section 1 identifies a quadrangular area circumscribed around the rotation path of the longest pointer of a plurality of pointers as a pointer movement area where images of the plurality of pointers are displayed. As a result of this configuration, a pointer movement area can be defined by two diagonally opposite points, which facilitates the address management of the pointer movement area. Also, even when the pointer movement area is divided into a plurality of segments, the management of each segment area can be easily performed.

Furthermore, in the present embodiment, a pointer movement area is subjected to a display operation in which, at every pointer movement timing, the display positions of a plurality of pointer images which change with time in accordance with time information are controlled, and an outer background area is subjected to a display operation in which a background image is displayed at timing that comes at intervals longer than those of the pointer movement timing. As a result of this configuration, an operation on an outer background area can be omitted which is performed to judge whether a scanning point is a position where a pointer image is displayed or is a position where a background image is displayed. In addition, the interval of updating a background image in an outer background area can be lengthened as compared to that in a pointer movement area.

Still further, in the present embodiment, when the display positions of a plurality of pointers that change with time in accordance with time information are all within one of a plurality of segment areas acquired by a pointer movement area being conceptually divided, this segment area is identified as a pointer presence area, and the segment area other than this pointer presence area is identified as a pointer absence area. Then, the pointer presence area and the pointer absence area are subjected to high-load and low-load display operations with different process loads, respectively. As a result of this configuration, an increase in a processing time can be suppressed even when a background image is displayed in a pointer movement area.

Yet still further, in the present embodiment, when a background image and pointer images are to be displayed on the dot matrix display section 5, a pointer presence area identified in a pointer movement area is subjected to an operation in which the plurality of pointer images are displayed on the background image while being subjected to an operation in which, at every pointer movement timing, whether a current scanning point is a position where one of the plurality of pointers is displayed or is a position where the background image is displayed is sequentially judged for each pixel by the pixels constituting the pointer presence area being scanned in predetermined directions. In addition, a pointer absence area identified in the pointer movement area is subjected to an operation in which the background image is displayed without the above-described judgment operation. As a result of this configuration, an increase in a processing time can be suppressed even when a background image is displayed in a pointer movement area. Also, in the present embodiment, as compared to a method where a background image and each pointer image are superimposed as layers and a method where each pointer image is superimposed on a background by using a sprite function, a special image superimposing apparatus or superimposing processing is not required, so that the processing load can be reduced. Accordingly, the present embodiment can be used also for small and power-saving electronic equipment such as wearable equipment.

In the above-described operation of displaying and moving a plurality of pointer images on a background image while judging, at every pointer movement timing, whether a current scanning point is a position where one of a plurality of pointers is displayed or is a position where a background is displayed, this judgment is made based on the premise that the hour hand, the minute hand, and the second hand constituting the plurality of pointers have been superimposed on the background in the order of the hour hand, the minute hand, and the second hand. As a result of this configuration, for example, when a judgment is made that a current scanning point is a position where the uppermost second hand is displayed, judgments thereafter, that is, judgments as to whether the current scanning point is a position where the minute hand, the hour hand, or the background is displayed are not required. That is, the judgment herein is efficiently made.

Yet still further, in the present embodiment, when the display positions of a plurality of pointers which change with time in accordance with time information are all within one of a plurality of segment areas acquired by a pointer movement area being conceptually divided, scanning directions for this segment area (pointer presence area) are changed depending on its location in the pointer movement area. As a result of this configuration, a pointer absence area can be scanned after a pointer presence area including all the display positions of a plurality of pointers is scanned.

The above-described plurality of segment areas acquired by the pointer movement area being conceptually divided are upper and lower areas acquired by the pointer movement area being divided in the vertical direction or right and left areas acquired by the pointer movement area being divided in the horizontal direction. Accordingly, areas acquired by a pointer movement area being divided into two substantially equal areas can be taken as a pointer presence area and a pointer absence area. That is, the entire pointer movement area can be easily divided into a plurality of areas.

Among the upper area and the lower area acquired by the pointer movement area being divided in the vertical direction or the right area and the left area acquired by the pointer movement area being divided in the horizontal direction, if the upper area includes all the display positions of the plurality of pointers which change with time in accordance with time information, the rightward direction serves as a horizontal scanning direction and the downward direction serves as a vertical scanning direction. In the case where the lower area includes all the display positions, the leftward direction serves as a horizontal scanning direction and the upward direction serves as a vertical scanning direction. In the case where the right area includes all the display positions, the leftward direction serves as a horizontal scanning direction and the downward direction serves as a vertical scanning direction. In the case where the left area includes all the display positions, the rightward direction serves as a horizontal scanning direction and the upward direction serves as a vertical scanning direction. As a result of this configuration, an area where the display positions of a plurality of pointers are all located can be quickly scanned.

Also, the above-described plurality of segment areas acquired by the pointer movement area being conceptually divided are areas determined with reference to the shapes and thicknesses of the plurality of pointers. That is, in the present embodiment, a pointer movement area is not entirely and equally divided, and can be unequally divided taking into consideration the shapes and thicknesses of pointers. Accordingly, even when the entire pointer movement area is divided into a plurality of areas, the pointers and the background can be accurately displayed.

Yet still further, in the present embodiment, when images for the display of an analog timepiece with a new design are generated based on images selected from among various pointer images and background images with different designs, a plurality of pointers and a background based on these generated images are displayed and the pointers are moved. As a result of this configuration, even a change in the design of analog timepiece display can be addressed similarly. Also, only by rendering on the image memory 5*a* of the dot matrix display section 5, a plurality of pointer images indicating pointer movements can be displayed on a background image without using a rewritable memory for superimposition.

By the above-described configuration, the present embodiment can suitably perform timepiece display processing even in a display apparatus where hardware and a processor for image processing such as sprite image display have been combined or a display apparatus not having a high-speed computing processor. Also, processing loads related to timepiece display processing can be reduced even if the present embodiment is applied in a display apparatus having the above-described structure.

First Modification Example

Figure 8A:
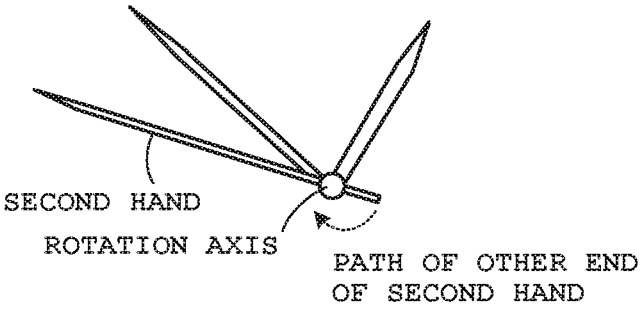
FIG. 8A is a diagram for describing a first modification example of the present embodiment.
Figure 8B:
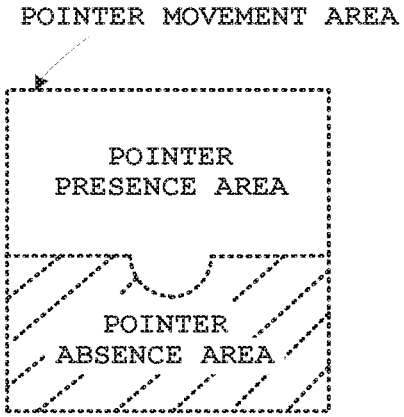
FIG. 8B is a diagram for describing the first modification example of the present embodiment.

In the above-described embodiment, pointer images have been exemplarily described which have designs where the rotation axis of each pointer is provided at a point where the other ends (opposite to the tip ends) of the pointers are superimposed and the other end of each pointer does not protrude from the rotation axis area, as shown in FIG. 2A. However, the present invention is not limited thereto. For example, in the case of a design where the other end of a pointer (second hand) protrudes from its rotation axis area as shown in FIG. 8A, the pointer movement area may be divided into a pointer presence area and a pointer absence area in consideration of the rotation path (semicircular area) of the other end. In FIG. 8B where an upper area in the pointer movement area is a pointer presence area and a lower area is a pointer absence area, the pointer presence area has been increased and the pointer absence area has been decreased by an amount equal to the rotation path (semicircular area) of the other end of the second hand.

That is, the pointer movement area has been divided such that an area equal to the rotation path (semicircular area) of the other end of the second hand is added to the pointer presence area and is subtracted from the pointer absence area at the center of a boundary line between the pointer presence area and the pointer absence area. By this configuration where a pointer movement area is exactly divided taking into consideration the shapes and thicknesses of pointers, a pointer presence area and a pointer absence area appropriate to the design of the pointers are provided, whereby pointer images and a background image therefor can be more accurately displayed.

Second Modification Example

Figure 9A:
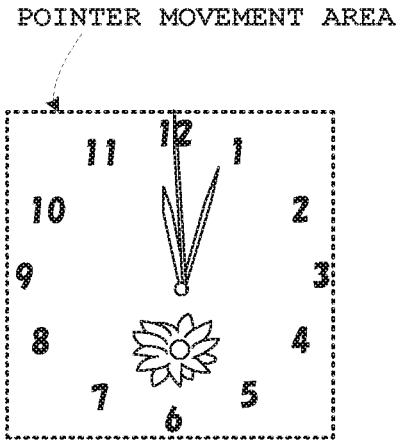
FIG. 9A is a diagram for describing a second modification example of the present embodiment.

In the above-described embodiment, the cases (four cases A to D) have been exemplarily described in which the entire pointer movement area is divided into an upper area and a lower area in the vertical direction or a right area and a left area in the horizontal direction. However, a configuration may be adopted in which a pointer movement area is divided into three areas in the horizontal direction, that is, a center area, a left area, and a right area. This configuration where a pointer movement area is divided into a left area, a center area, and a right area in the horizontal direction is described using cases A, B, and C based on which area the display positions of pointers are all located. FIG. 9A shows a case (case B) where the display positions of the pointers are all within the center area of the pointer movement area, and FIG. 9B shows a case where the center area has been taken as a pointer presence area and the left and right areas have been taken as pointer absence areas.

Also, a similar configuration may be adopted in which a pointer movement area is divided into three areas in the vertical direction, that is, a center area, an upper area, and a lower area. This configuration where a pointer movement area is divided into an upper area, a center area, and a lower area in the vertical direction is described using cases D, E, and F based on which area the display positions of pointers are all located. FIG. 9C shows a case (case E) where the display positions of the pointers are all within the center area of the pointer movement area, and FIG. 9D shows a case in which the center area has been taken as a pointer presence area and the upper and lower areas have been taken as pointer absence areas.

Figure 9B:
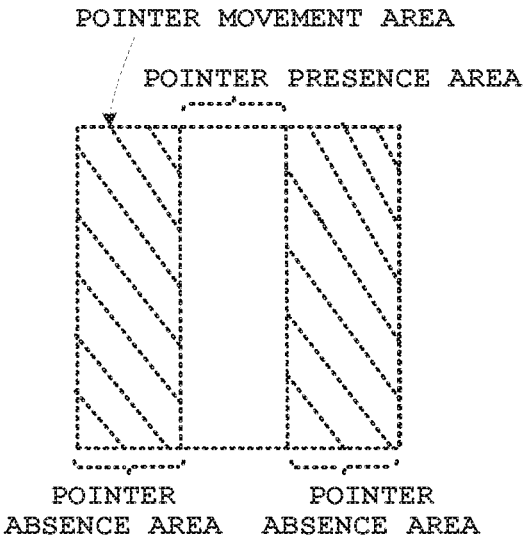
FIG. 9B is a diagram for describing the second modification example of the present embodiment.
Figure 9C:
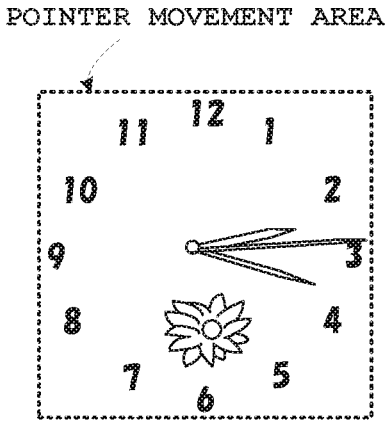
FIG. 9C is a diagram for describing the second modification example of the present embodiment.
Figure 9D:
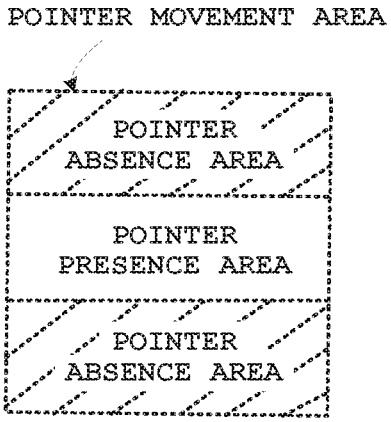
FIG. 9D is a diagram for describing the second modification example of the present embodiment.

In the example of FIG. 9B, a pointer movement area is divided into three area in the horizontal direction, that is, a center area, a left area, and a right area. However, this center area may be further divided into two areas in the vertical direction, that is, an upper center area and a lower center area. In this case, if the display positions of the plurality of pointers are all within the upper center area as shown in FIG. 9B, the upper center area is taken as a pointer presence area and the lower center area is taken as a pointer absence area. This applies to the configuration where a pointer movement area is divided into three areas in the vertical direction, that is, a center area, an upper area, and a lower area. In this configuration as well, the center area may be further divided into two areas in the horizontal direction, that is, a right center area and a left center area. As such, by a pointer presence area being finely divided, a pointer absence area can be widened accordingly.

Third Modification Example

Figure 10A:
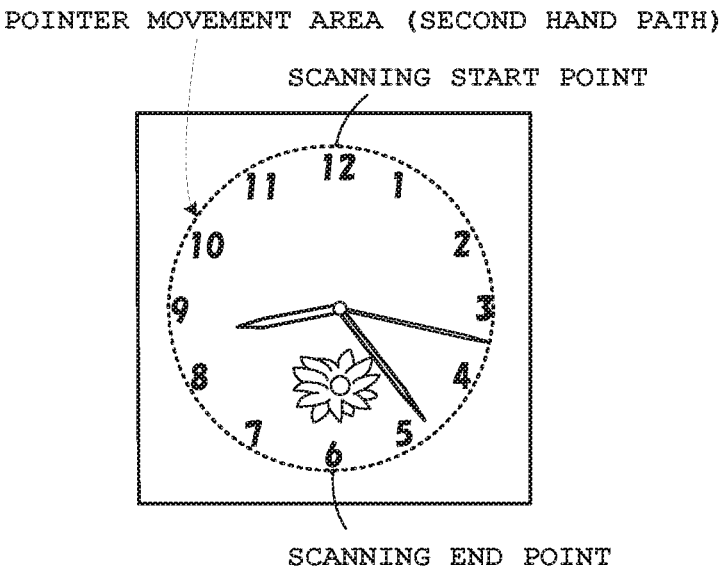
FIG. 10A is a diagram for describing a third modification example of the present embodiment.
Figure 10B:
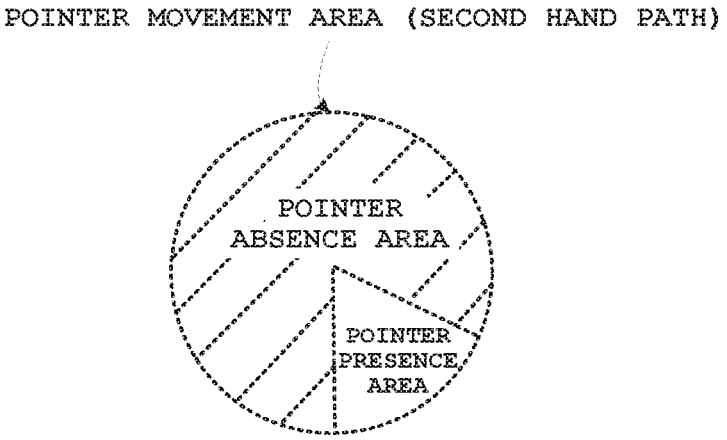
FIG. 10B is a diagram for describing the third modification example of the present embodiment.

In the above-described embodiment, a second hand path (circular rotation path) when the longest pointer (second hand) among a plurality of pointers is rotated once around its rotation axis in a timepiece display area is found, and a virtual square frame circumscribed around this circular second hand path is identified as a pointer movement area. However, a configuration may be adopted in which this circular second hand path is identified directly as a pointer movement area as shown in FIG. 10A, so that the outer background area is widen. In this case, the uppermost point of the circle is taken as a scanning start point and the lowermost point thereof is taken as a scanning end point. In a case where this circular pointer movement area is divided into a plurality of areas, for example, the entire pointer movement area may be radially divided at every predetermined angle (for example, 60 degrees) with the rotation axes of the pointers as a center, as shown in FIG. 10B.

In the above-described embodiment, when images of a new design for analog timepiece display are generated based on images selected from various pointer images and background images with different designs, a plurality of pointers and a background are simultaneously displayed based on these generated images. However, the plurality of pointers and the background may be separately displayed. That is, even if the pointers and the background are displayed at shifted timings, the pointers can be displayed and moved on the background.

Also, in the above-described embodiment, an area (a pointer movement area or a pointer presence area in the pointer movement area) where a plurality of pointer images are displayed is identified, and high-load and low-load display operations with different processing loads are performed on the identified area and the area (an outer background area outside the pointer movement area or a pointer absence area in the pointer movement area) other than the identified area, respectively. However, these high-load and low-load display operations may be switched to each other. That is, a display operation with a processing load larger than that for the pointer movement area may be performed on the outer background area when, for example, a moving image with a speed higher than the pointer movement timing is displayed as an outer background in the outer background area. In addition, a display operation with a processing load larger than that for the pointer presence area may be performed on the pointer absence area in the pointer movement area. Also, in the present embodiment, analog timepiece display with three pointers has been exemplarily described. However, analog timepiece display with two pointers or four pointers may be performed.

Note that, although not particularly mentioned in the above-described embodiment, a memory-type liquid-crystal display may be used as the dot matrix display section 5. This is effective when background display is continued after power-off, and a processing load on the display can be further reduced thereby.

Also, in the above-described embodiment, the present invention has been applied to a wristwatch apparatus as an image display apparatus. However, the present invention is not limited thereto, and may be applied to a personal computer, a PDA (personal digital assistant), a tablet terminal apparatus, a portable telephone such as smartphone, an electronic game machine, a music player, and the like equipped with an analog timepiece display function.

Moreover, the "devices" or the "sections" described in the above-described embodiment are not required to be in a single housing and may be separated into a plurality of housings by function. In addition, the steps in the above-described flowcharts are not required to be processed in time-series, and may be processed in parallel, or individually and independently.

While the present invention has been described with reference to the preferred embodiments, it is intended that the invention be not limited by any of the details of the description therein but includes all the embodiments which fall within the scope of the appended claims.

What is claimed is:

1. An image display apparatus comprising:

a processor; and a display comprising a plurality of pixels, wherein the processor is configured to:

acquire time information;

determine display positions of a plurality of pointer images in a display area of the display based on the time information, wherein each of the plurality of pointer images displays one of a plurality of pointers, wherein the plurality of pointer images comprises a longest pointer image that is the longest of the plurality of pointers, wherein the plurality of pointer images is sequentially displayed at a plurality of positions based on the time information so that the plurality of pointer images appears to rotate on a rotation path about a rotation axis, wherein the rotation path of the longest pointer image defines a pointer movement area, and wherein a plurality of segment areas is defined by dividing the pointer movement area;

identify, in the display area of the display:

one of the plurality of segment areas including the display positions of the plurality of pointer images as a first area;

an outer area outside the pointer movement area as a second area; and all segment area or areas of the plurality of segment areas in the pointer movement area other than the first area as a third area; and control the display to display the plurality of pointer images and a background image, wherein in controlling the display to display the plurality of pointer images and the background image, the processor is configured to:

for each of the plurality of pixels in the first area of the display area of the display, perform a high-load display operation comprising:

perform a judging operation of judging whether the each of the plurality of pixels coincides with a display position of one of the plurality of pointer images or the background image; and display one of the background image and the one of the plurality of pointer images based on a result of the judging operation;

for each of the plurality of pixels in the second area of the display area of the display, perform a low-load display operation for displaying the background image without performing the judging operation; and for each of the plurality of pixels in the third area of the display area of the display, perform the low-load display operation for displaying the background image without performing the judging operation.

2. The image display apparatus according to claim 1, wherein the processor is configured to identify, in the display area of the display, a quadrangular area circumscribing the rotation path of the longest pointer image as the pointer movement area.

3. The image display apparatus according to claim 1, wherein, in controlling the display to display the plurality of pointer images and the background image, the processor is configured to:

perform, as the high-load display operation, a display operation on the pointer movement area for controlling, at timing that comes at first intervals, display positions of the plurality of pointer images and the background image; and perform, as the low-load display operation, a display operation on the outer area for controlling, at timing that comes at second intervals longer than the first intervals, displaying the background image.

4. The image display apparatus according to claim 1, wherein the processor is configured to perform the judging operation of the high-load display operation for the each of the plurality of pixels in the first area of the display area of the display by scanning the each of the plurality of pixels in the first area in predetermined directions.

5. The image display apparatus according to claim 4, wherein the processor is configured to perform the judging operation based on a premise that an hour hand image, a minute hand image, and a second hand image of the plurality of pointer images have been superimposed on the background image in the order of the hour hand image, the minute hand image, and the second hand image.

6. The image display apparatus according to claim 1, wherein, in controlling the display to display the plurality of pointer images and the background image, the processor is configured to change a scanning direction or a scanning start point for the first area of the display area based on a location of the first area in the display area.

7. The image display apparatus according to claim 1, wherein the first area and the third area are arranged within the pointer movement area as:

an upper area and a lower area of the pointer movement area; or a right area and a left area of the pointer movement area.

8. The image display apparatus according to claim 7, wherein the processor is configured to change a scanning direction or a scanning start point for the first area based on whether the first area is the upper area, the lower area, the right area, or the left area.

9. The image display apparatus according to claim 1, wherein the plurality of segment areas is defined by the pointer movement area being divided based on shapes and thicknesses of the plurality of pointer images.

10. The image display apparatus according to claim 1, wherein the processor is configured to:

select one design of the plurality of pointer images from a plurality of designs of the plurality of pointer images;

select one design of the background image from a plurality of designs of the background image; and control the display to display the plurality of pointer images of the one design selected and the background image of the one design selected.

11. The image display apparatus according to claim 1, wherein the high-load display operation involves higher processing amounts or higher processing times compared to the low-load display operation.

12. The image display apparatus according to claim 1, wherein the processor is configured to:

select one design of the plurality of pointer images from a plurality of designs of the plurality of pointer images;

select one design of the background image from a plurality of designs of the background image; and control the display to display the plurality of pointer images of the one design selected and the background image of the one design selected, separately.

13. An image display method comprising:

acquiring time information;

determining display positions of a plurality of pointer images in a display area of a display comprising a plurality of pixels, based on the time information, wherein each of the plurality of pointer images displays one of a plurality of pointers, wherein the plurality of pointer images comprises a longest pointer image that is the longest of the plurality of pointers, wherein the plurality of pointer images is sequentially displayed at a plurality of positions based on the time information so that the plurality of pointer images appears to rotate on a rotation path about a rotation axis, wherein the rotation path of the longest pointer image defines a pointer movement area, and wherein a plurality of segment areas is defined by dividing the pointer movement area;

identifying, in the display area of the display:

one of the plurality of segment areas including the display positions of the plurality of pointer images as a first area;

an outer area outside the pointer movement area as a second area; and all segment area or areas of the plurality of segment areas in the pointer movement area other than the first area as a third area; and controlling the display to display the plurality of pointer images and a background image, wherein controlling the display to display the plurality of pointer images and the background image comprises:

for each of the plurality of pixels in the first area of the display area of the display, performing a high-load display operation comprising:

performing a judging operation of judging whether the each of the plurality of pixels coincides with a display position of one of the plurality of pointer images or the background image; and displaying one of the background image and the one of the plurality of pointer images based on a result of the judging operation;

for each of the plurality of pixels in the second area of the display area of the display, performing a low-load display operation for displaying the background image without performing the judging operation; and for each of the plurality of pixels in the third area of the display area of the display, performing the low-load display operation for displaying the background image without performing the judging operation.

14. A non-transitory computer-readable storage medium having stored thereon a program that is executable by a computer to actualize functions comprising:

acquiring time information;

determining display positions of a plurality of pointer images in a display area of a display comprising a plurality of pixels, based on the time information, wherein each of the plurality of pointer images displays one of a plurality of pointers, wherein the plurality of pointer images comprises a longest pointer image that is the longest of the plurality of pointers, wherein the plurality of pointer images is sequentially displayed at a plurality of positions based on the time information so that the plurality of pointer images appears to rotate on a rotation path about a rotation axis, wherein the rotation path of the longest pointer image defines a pointer movement area, and wherein a plurality of segment areas is defined by dividing the pointer movement area;

identifying, in the display area of the display:

one of the plurality of segment areas including the display positions of the plurality of pointer images as a first area;

an outer area outside the pointer movement area as a second area; and all segment area or areas of the plurality of segment areas in the pointer movement area other than the first area as a third area; and controlling the display to display the plurality of pointer images and a background image, wherein controlling the display to display the plurality of pointer images and the background image comprises:

for each of the plurality of pixels in the first area of the display area of the display, performing a high-load display operation comprising:

performing a judging operation of judging whether the each of the plurality of pixels coincides with a display position of one of the plurality of pointer images or the background image; and displaying one of the background image and the one of the plurality of pointer images based on a result of the judging operation;

for each of the plurality of pixels in the second area of the display area of the display, performing a low-load display operation for displaying the background image without performing the judging operation; and for each of the plurality of pixels in the third area of the display area of the display, performing the low-load display operation for displaying the background images without performing the judging operation.

* * * * *